US012677953B2

(12) United States Patent
Samikkannu et al.

(10) Patent No.: US 12,677,953 B2
(45) Date of Patent: Jul. 14, 2026

(54) FOLDABLE SEAT WITH DEPLOYABLE MOBILITY STRUCTURE

(71) Applicant: AmTab Manufacturing Corporation, Bensenville, IL (US)

(72) Inventors: Doss Samikkannu, Des Plaines, IL (US); Jeremias Rivera, Elmhurst, IL (US)

(73) Assignee: AmTab Manufacturing Corporation, Bensenville, IL (US)

( * ) Notice: Subject to any disclaimer, the term of this patent is extended or adjusted under 35 U.S.C. 154(b) by 107 days.

(21) Appl. No.: 18/678,301

(22) Filed: May 30, 2024

(65) Prior Publication Data

US 2025/0311851 A1 Oct. 9, 2025

Related U.S. Application Data

(60) Provisional application No. 63/631,512, filed on Apr. 9, 2024.

(51) Int. Cl.

| | |
|---|---|
| ***A47C 7/58*** | (2006.01) |
| ***A47C 4/04*** | (2006.01) |
| ***A47C 7/00*** | (2006.01) |
| *A47C 11/00* | (2006.01) |

(52) U.S. Cl.
CPC ..... *A47C 7/58* (2013.01); *A47C 4/04* (2013.01); *A47C 7/006* (2013.01); *A47C 11/00* (2013.01)

(58) Field of Classification Search
CPC ..... A47C 1/121; A47C 7/566; A47C 7/006; A47C 11/00; A47C 44/04
USPC ..... 297/334, 332, 338, 158.4
See application file for complete search history.

(56) References Cited

U.S. PATENT DOCUMENTS

| | | | | |
|---|---|---|---|---|
| 3,028,197 | A | 4/1962 | Wilson | |
| 3,061,369 | A | 10/1962 | Haunost | |
| 3,337,262 | A | 8/1967 | Katzfey et al. | |
| 3,594,037 | A | 7/1971 | Sherman | |
| 3,715,143 | A | 2/1973 | Gerken et al. | |
| 4,606,575 | A | 8/1986 | Kodet | |
| 4,949,649 | A | 8/1990 | Terres et al. | |
| 5,349,789 | A | 9/1994 | Andert et al. | |
| 5,392,718 | A | 2/1995 | Stevens | |
| 5,615,451 | A | 4/1997 | Peterson et al. | |
| 7,226,125 | B2 * | 6/2007 | Frobose | A47B 3/14 297/118 |
| 7,469,966 | B1 | 12/2008 | Vallee | |

(Continued)

*Primary Examiner* — Jose V Chen
(74) *Attorney, Agent, or Firm* — HONIGMAN LLP

(57) ABSTRACT

A seating assembly includes a frame supporting a seat and a backrest. The frame includes a stationary base and a mobile base. A pivot link pivotally connects between the seat and the mobile base. The seating assembly is adjustable between a sitting position and a mobile position. In the sitting position, the stationary base supports the seating assembly, the sitting surface extends parallel to the ground, and the mobile base is vertically spaced from the ground. In the mobile position, the seat is pivoted relative to the frame toward the backrest, the mobile base supports the seating assembly, and the stationary base is vertically spaced from the ground. As the seating assembly is adjusted between the sitting and mobile positions, the pivot link pivots relative to the seat and the mobile base to impart vertical movement of the mobile base relative to the stationary base and the ground.

20 Claims, 12 Drawing Sheets

(56) References Cited

U.S. PATENT DOCUMENTS

| | | | | |
|---|---|---|---|---|
| 8,182,032 | B2 | 5/2012 | Dickey et al. | |
| 8,820,826 | B2 * | 9/2014 | Dickey | A47C 13/00 297/121 |
| 9,370,265 | B2 * | 6/2016 | Whittington | A47C 7/006 |
| 9,738,116 | B1 * | 8/2017 | Rivera, Jr. | A47C 11/00 |
| 9,980,583 | B2 * | 5/2018 | Rivera, Jr. | B60B 33/006 |
| 10,376,062 | B2 * | 8/2019 | Rivera, Jr. | B60B 33/063 |
| 2008/0116724 | A1 | 5/2008 | Dickey | |

* cited by examiner

FOLDABLE SEAT WITH DEPLOYABLE MOBILITY STRUCTURE

CROSS REFERENCE TO RELATED APPLICATION

The present application claims the filing benefits of U.S. provisional application Ser. No. 63/631,512, filed Apr. 9, 2024, which is hereby incorporated herein by reference in its entirety.

TECHNICAL FIELD

This disclosure relates to foldable bench seating, and more particularly to foldable bench seating with a mobility structure deployable based on folding of the bench seat.

BACKGROUND

It is known to provide bench seating structures along sides of a table, such as for booth seating in restaurants, bars, and coffee shops. Typically, these bench seating structures are relatively heavy and bulky and/or fixed in place, such as to prevent shifting of the seating relative to tables and to maintain a furniture layout of the environment. However, the relative immobility of traditional bench seating structures prevents their use in flexible and multi-purpose spaces, such as school cafeterias, classrooms, libraries, food courts, and hospitals, where furniture may frequently be moved to adjust layout or removed for storage.

SUMMARY

One aspect of the disclosure provides a seating assembly. The seating assembly includes a seat having a sitting surface, a backrest, and a frame supporting the seat and the backrest. The frame includes a stationary base and a mobile base. A pivot link is pivotally connected between the seat and the mobile base. The seating assembly is adjustable between a sitting position and a mobile position. In the sitting position, the stationary base supports the seating assembly on a ground surface, the sitting surface extends generally parallel to the ground surface, and the mobile base is vertically spaced from the ground surface. In the mobile position, the seat is pivoted relative to the frame to move the sitting surface toward the backrest, the mobile base supports the seating assembly on the ground surface, and the stationary base is vertically spaced from the ground surface. As the seating assembly is adjusted between the sitting position and the mobile position, the pivot link pivots relative to the seat and the mobile base to impart vertical movement of the mobile base relative to the stationary base and the ground surface.

Implementations of the disclosure may include one or more of the following optional features. In some implementations, the seat includes a pivot member pivotally connected to the frame and defining a pivot axis. The seat pivots about the pivot axis as the seating assembly is adjusted between the sitting position and the mobile position. In further implementations, a yoke extends from the pivot member and pivots about the pivot axis together and in tandem with the seat. The pivot link is pivotally connected to the yoke.

In some examples, the pivot link includes a bar having a first end and a second end opposite the first end. The first end is pivotally connected relative to the seat. The second end is pivotally connected to the mobile base.

In some aspects, the mobile base includes a support member at least partially received along a bore of the stationary base. The support member moves along the bore as the mobile base moves vertically relative to the stationary base and the ground surface. In further aspects, the seating assembly further includes a biasing member along the bore between the stationary base and the mobile base. The biasing member urges the mobile base away from the stationary base toward the ground surface to bias the frame toward the mobile position.

In some implementations, the seating assembly further includes a biasing mechanism between the frame and the seat. With the seating assembly in the sitting position, the biasing mechanism urges the seat toward the backrest to bias the seating assembly toward the mobile position. In further implementations, the seating assembly further includes a dampening mechanism between the frame and the seat. The dampening mechanism engages as the seating assembly approaches the sitting position to dampen pivotal movement of the seat relative to the frame.

In some examples, the seat includes a tab and the frame includes a post. The tab pivots together and in tandem with the seat. With the frame adjusted to the mobile position, the tab engages the post to preclude further pivoting of the seat toward the backrest and further adjustment of the seating assembly from the sitting position beyond the mobile position.

In some aspects, the mobile base includes a set of casters. With the seating assembly in the mobile position, the set of casters enable movement of the seating assembly along the ground surface.

Another aspect of the disclosure provides a seating assembly. The seating assembly includes a seat having a sitting surface and a backrest. A frame supports the seat and the backrest. The frame includes a stationary base and a mobile base. The mobile base includes a support member at least partially received along a bore of the stationary base. A pivot link is pivotally connected between the seat and the mobile base. The seating assembly is adjustable between a sitting position and a mobile position. In the sitting position, the stationary base supports the seating assembly on a ground surface, the sitting surface extends generally parallel to the ground surface, and the mobile base is vertically spaced from the ground surface. In the mobile position, the seat is pivoted relative to the frame to move the sitting surface toward the backrest, the mobile base supports the seating assembly on the ground surface, and the stationary base is vertically spaced from the ground surface. As the seating assembly is adjusted between the sitting position and the mobile position, the pivot link pivots relative to the seat and the mobile base to impart vertical movement of the mobile base relative to the stationary base and the ground surface. The support member of the mobile base moves along the bore of the stationary base as the mobile base moves vertically relative to the stationary base and the ground surface. The seat includes a tab and the frame includes a post. The tab pivots together and in tandem with the seat. With the seating assembly in the mobile position, the tab engages the post to preclude further pivoting of the seat toward the backrest and further adjustment of the seating assembly from the sitting position beyond the mobile position. This aspect may include one or more of the following optional features.

In some implementations, the seat includes a pivot member pivotally connected to the frame and defining a pivot axis. The seat pivots about the pivot axis as the seating assembly is adjusted between the sitting position and the mobile position. In some examples, the pivot link includes a bar having a first end pivotally connected relative to the seat and a second end opposite the first end pivotally connected to the mobile base.

In some aspects, the seating assembly further includes a biasing member along the bore between the stationary base and the mobile base that urges the mobile base away from the stationary base toward the ground surface to bias the frame toward the mobile position. In some implementations, the seating assembly further includes a biasing mechanism between the frame and the seat. With the seating assembly in the sitting position, the biasing mechanism urges the seat toward the backrest to bias the seating assembly toward the mobile position.

Yet another aspect of the disclosure provides a seating assembly. The seating assembly includes a seat having a sitting surface and a pivot member, and a backrest. A frame supports the seat and the backrest. The frame includes a stationary base and a mobile base. The mobile base includes a support member at least partially received along a bore of the stationary base. The pivot member of the seat is pivotally connected to the frame and defines a pivot axis. A pivot link is pivotally connected between the mobile base and a yoke that extends from the pivot member. The yoke pivots together and in tandem with the seat. The seating assembly is adjustable between a sitting position and a mobile position. In the sitting position, the stationary base supports the seating assembly on a ground surface, the sitting surface extends generally parallel to the ground surface, and the mobile base is vertically spaced from the ground surface. In the mobile position, the seat is pivoted relative to the frame about the pivot axis to move the sitting surface toward the backrest, the mobile base supports the seating assembly on the ground surface, and the stationary base is vertically spaced from the ground surface. As the seating assembly is adjusted between the sitting position and the mobile position, the pivot link pivots relative to the seat and the mobile base to impart vertical movement of the mobile base relative to the stationary base and the ground surface. The support member of the mobile base moves along the bore of the stationary base as the mobile base moves vertically relative to the stationary base and the ground surface. This aspect may include one or more of the following optional features.

In some implementations, the pivot link includes a bar having a first end pivotally connected relative to the seat and a second end opposite the first end pivotally connected to the mobile base. In some examples, the seating assembly further includes a biasing member along the bore between the stationary base and the mobile base that urges the mobile base away from the stationary base toward the ground surface to bias the frame toward the mobile position. In some aspects, the seating assembly further includes a dampening mechanism between the frame and the seat. The dampening mechanism engages as the seat assembly approaches the sitting position to dampen pivotal movement of the seat relative to the frame.

In some implementations, the seat includes a tab and the frame includes a post. The tab pivots together and in tandem with the seat. With the seating assembly in the mobile position, the tab engages the post to preclude further pivoting of the seat toward the backrest and further adjustment of the seating assembly from the sitting position beyond the mobile position.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
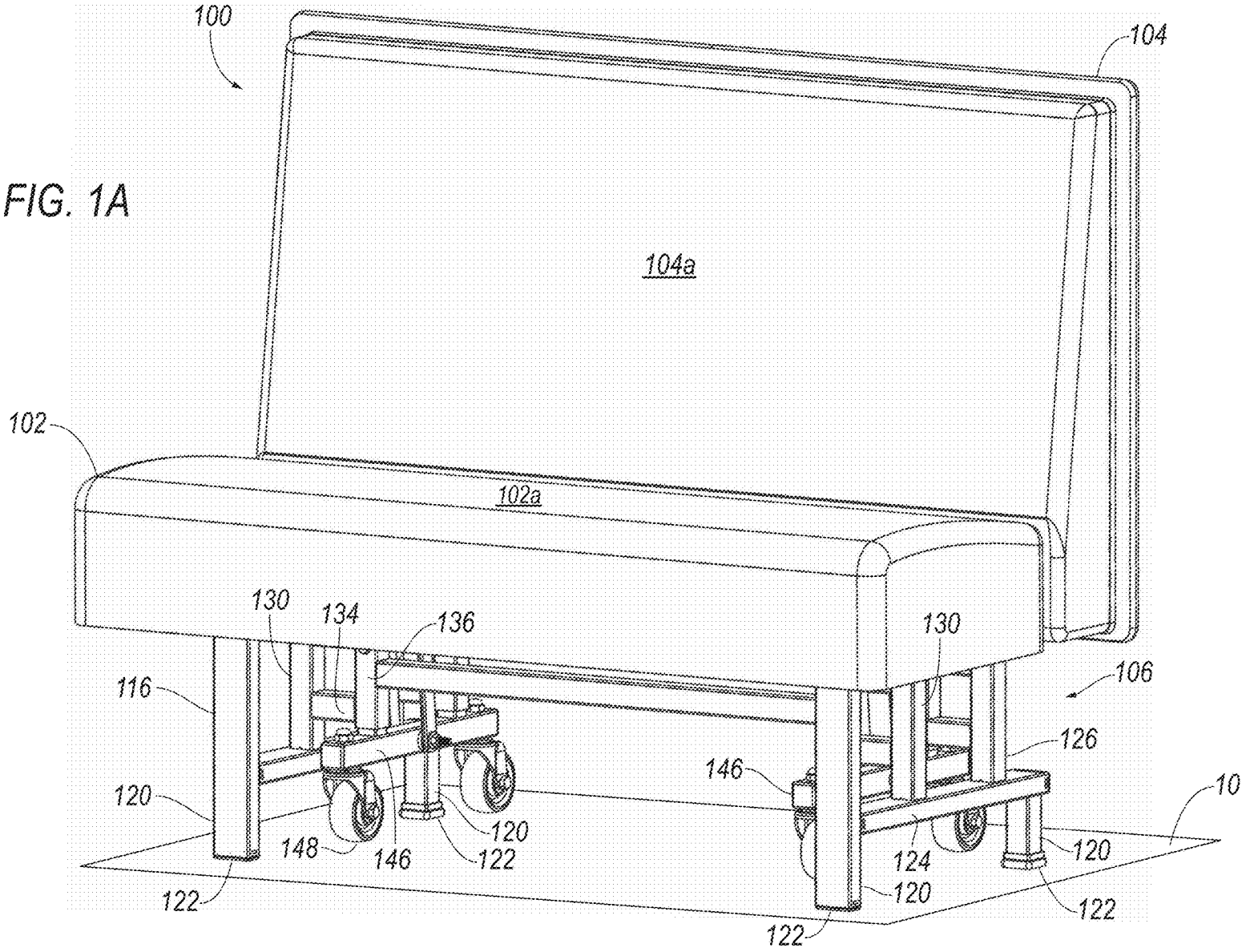
FIGS. 1A and 1B are perspective views of a seating assembly respectively in a sitting position and a mobile position.
Figure 1B:
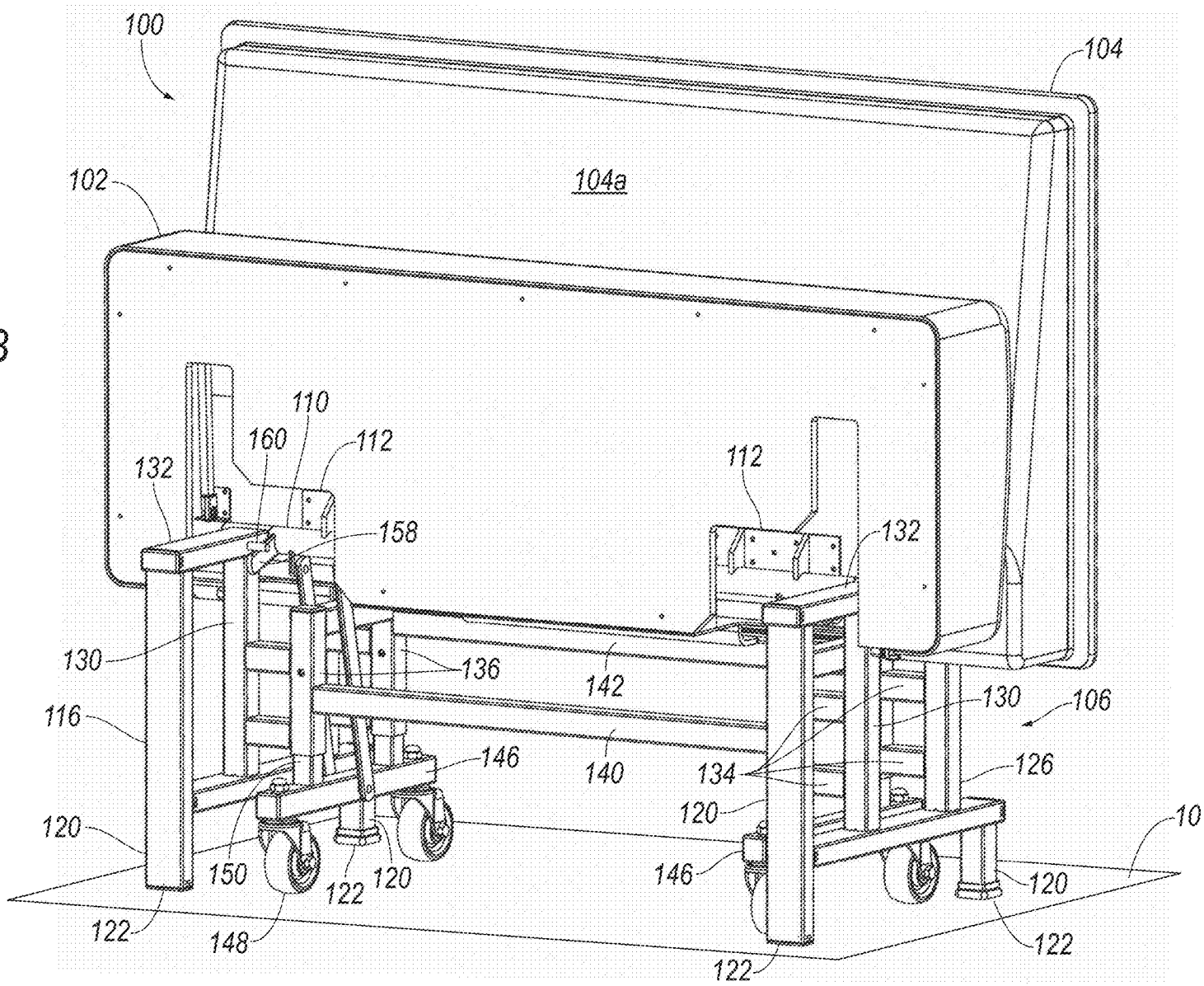

Referring to FIGS. 1A and 1B, a seating assembly 100 includes a seat 102, such as a bench seat configured to accommodate one or more users sitting at the seating assembly 100, and a backrest 104. The seat 102 provides a sitting surface 102*a* and the backrest provides a forward surface 104*a* for supporting the one or more users. The seating assembly 100 is adjustable between a sitting position (FIG. 1A) and a mobile position (FIG. 1B). In the sitting position, the seating assembly 100 is stationary relative to a ground surface 10 and the seat 102 is extended relative to the backrest 104 to receive the one or more users. In the mobile position, the seating assembly 100 is movable along the ground surface 10 and the seat 102 is pivoted toward the backrest 104. The seating assembly 100 may include characteristics of the mobile folding benches described in U.S. Pat. Nos. 10,376,062; 9,980,583 and/or 9,738,116, which are hereby incorporated herein by reference in their entireties.

As described below, the seating assembly 100 is equipped with a linkage mechanism to translate pivotal movement of the seat 102 relative to the backrest 104 into vertical movement of a mobility structure relative to the ground surface 10. When the seat 102 is pivoted from its use position in the sitting position toward its non-use position in the mobile position, the linkage mechanism causes the mobility structure to engage the ground surface 10 and support the seating assembly 100 so that the seating assembly 100 may be moved within its environment via the mobility structure. Moreover, the seating assembly 100 may be equipped with one or more biasing mechanisms to retain the seating assembly 100 in one or both of the sitting position and the mobile position and/or to assist the user in adjusting the seating assembly 100 between positions. Thus, by manipulating the pivotal position of the seat 102 relative to the backrest 104, the user may adjust the seating assembly 100 to the mobile position to move the seating assembly 100 within and remove the seating assembly 100 from an environment and, with the seating assembly 100 at a desired position within the environment, the user may adjust the seating assembly 100 to the sitting position to set the position of the seating assembly 100 and provide stable seating support. For example, the user may simply lift the seat 102 upward to pivot the seat 102 and adjust the seating assembly 100 from the sitting position toward the mobile position and the user may press down on the seat 102 to pivot the seat 102 and adjust the seating assembly 100 from the mobile position toward the sitting position. Although not shown, in some examples, the seat 102 may include a handle at a lower surface for grasping by the user when pivoting the seat 102 relative to the backrest 104.

Figure 2A:
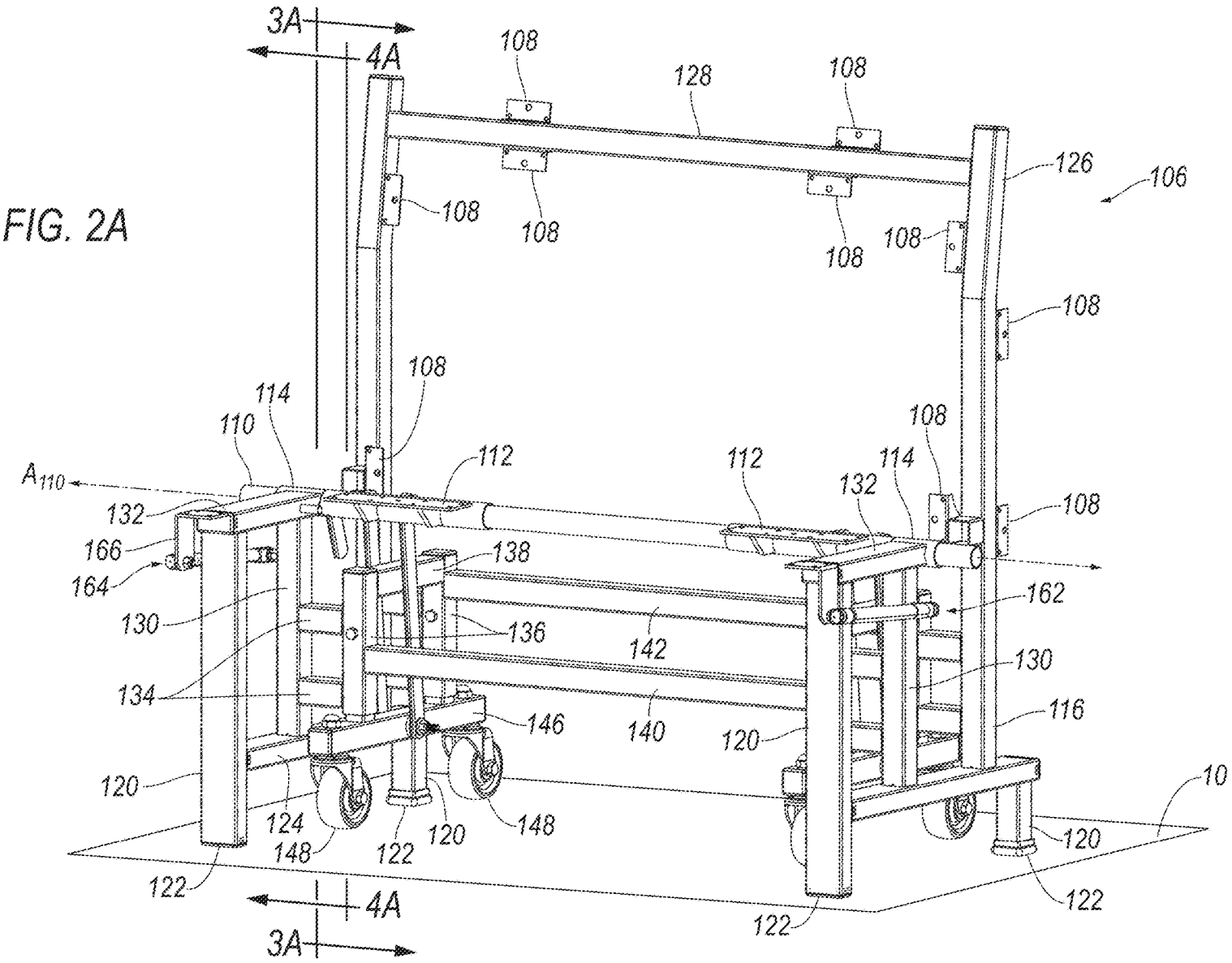
FIGS. 2A and 2B are perspective views of the seating assembly respectively in the sitting position and mobile position, with a seat and backrest of the seating assembly removed.
Figure 2B:
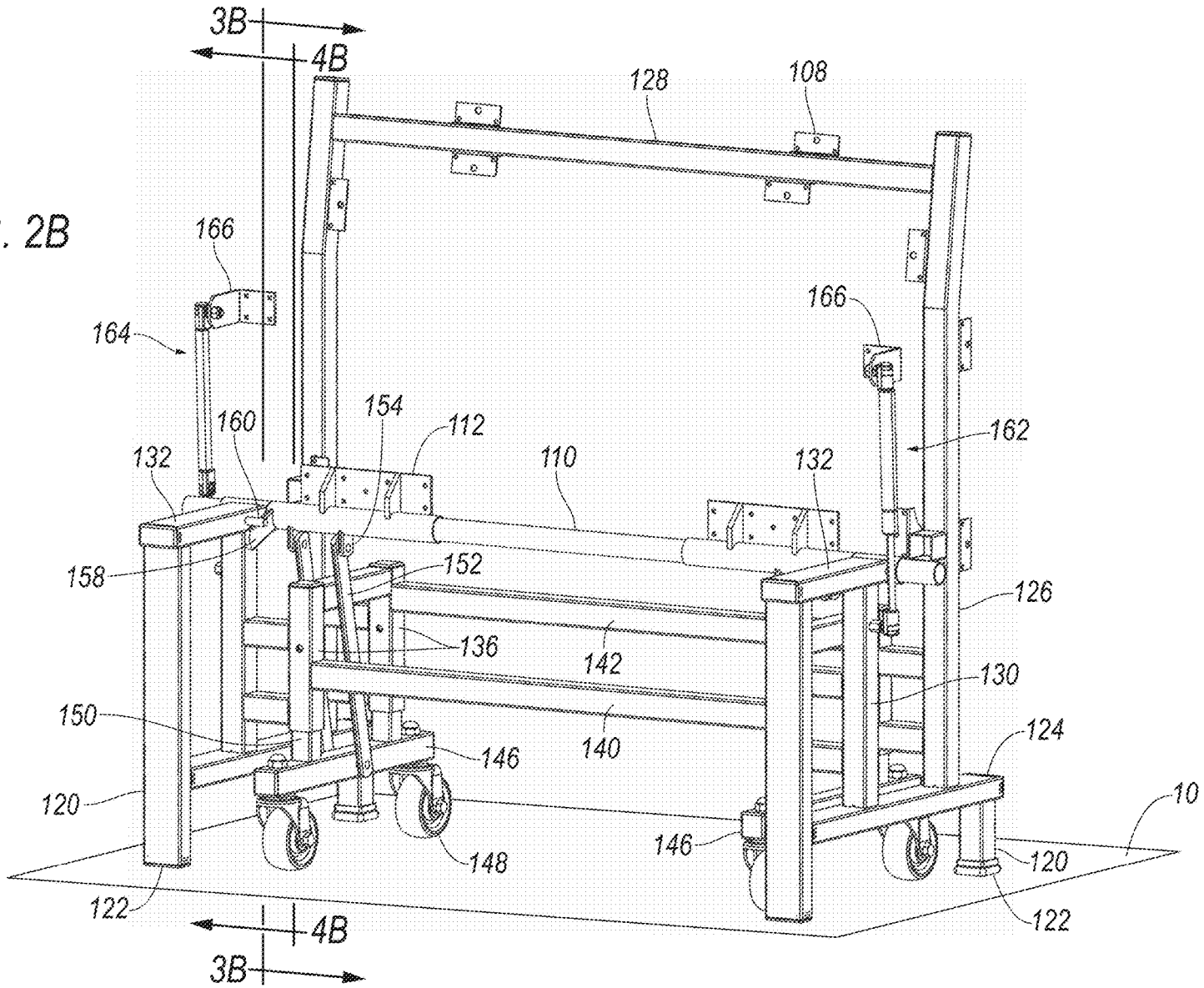

As shown in FIGS. 2A and 2B, the seating assembly 100 includes a frame 106 that supports the seat 102 and the backrest 104. For example, the backrest 104 is fixedly attached to the frame 106 via threaded fasteners extending through mounting brackets 108 at the frame 106 and that are received at threaded receiving portions of the backrest 104. The seat 102 is pivotally attached at the frame 106 and pivoting of the seat 102 relative to the frame 106 adjusts the seating assembly 100 between the sitting position (FIG. 2A) and the mobile position (FIG. 2B). In the illustrated example, the seat 102 is attached to mounting brackets 112 attached at a pivot member or axle 110, so that the pivot axle 110 may pivotally connect the seat at the frame 106. For example, bearings 114 at the frame 106 receive opposing ends of the pivot axle 110 to allow the seat 102 to pivot relative to the frame 106. The pivot axle 110 defines a pivot axis $A_{110}$ and the seat 102 pivots about the pivot axis $A_{110}$ relative to the frame 106 as the seating assembly 100 is adjusted between the sitting position and the mobile position. Thus, when the seat 102 is pivoted from the sitting position, where the sitting surface 102*a* extends generally horizontal or parallel to the ground surface 10 so that a user can sit on the seat 102, toward the mobile position, the seat 102 is pivoted relative to the frame 106 about the pivot axis $A_{110}$ such that the sitting surface 102*a* moves toward the forward surface 104*a* of the backrest 104.

Figure 3A:
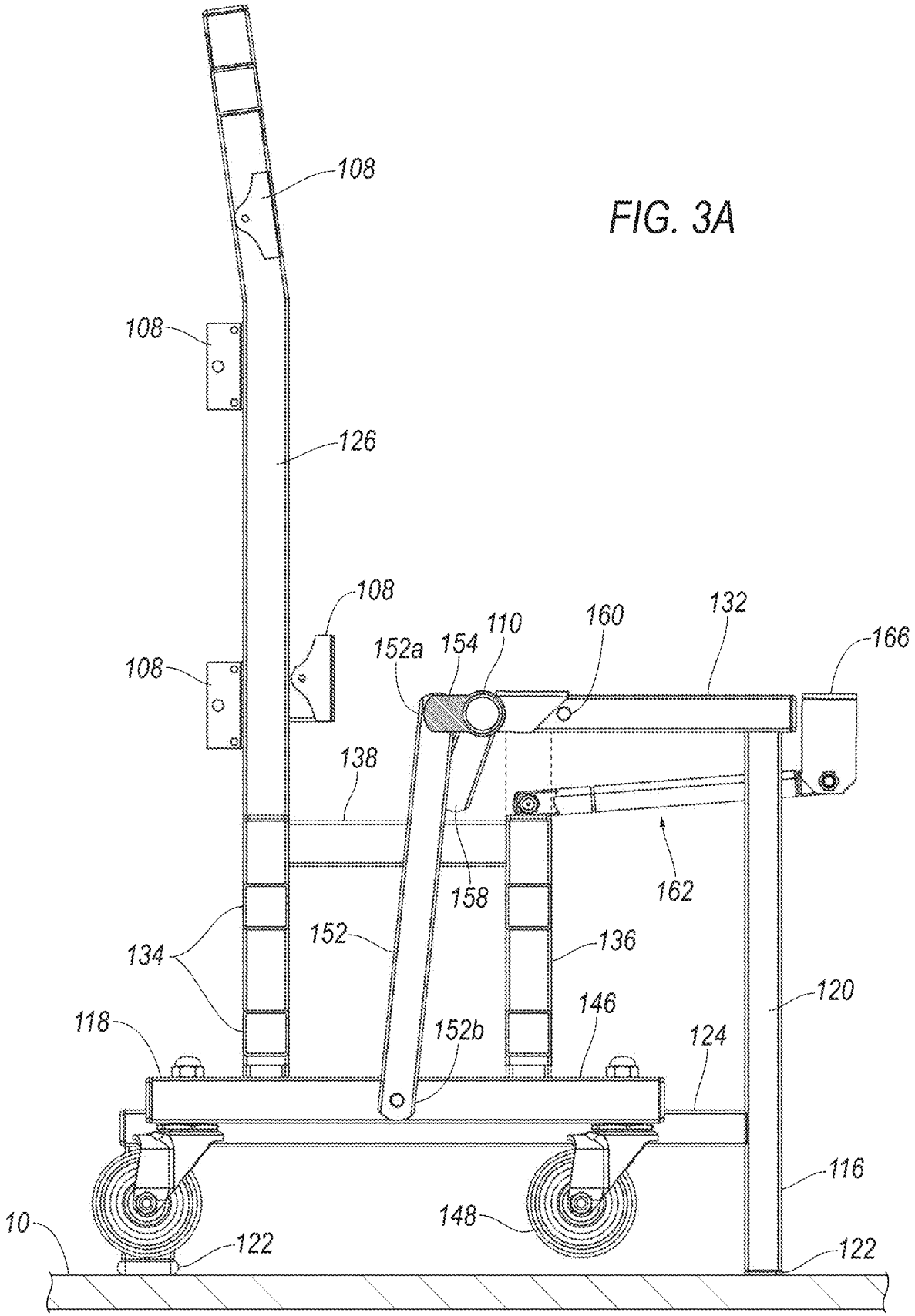
FIG. 3A is a sectional view of the seating assembly taken along the line 3A-3A of FIG. 2A.
Figure 3B:
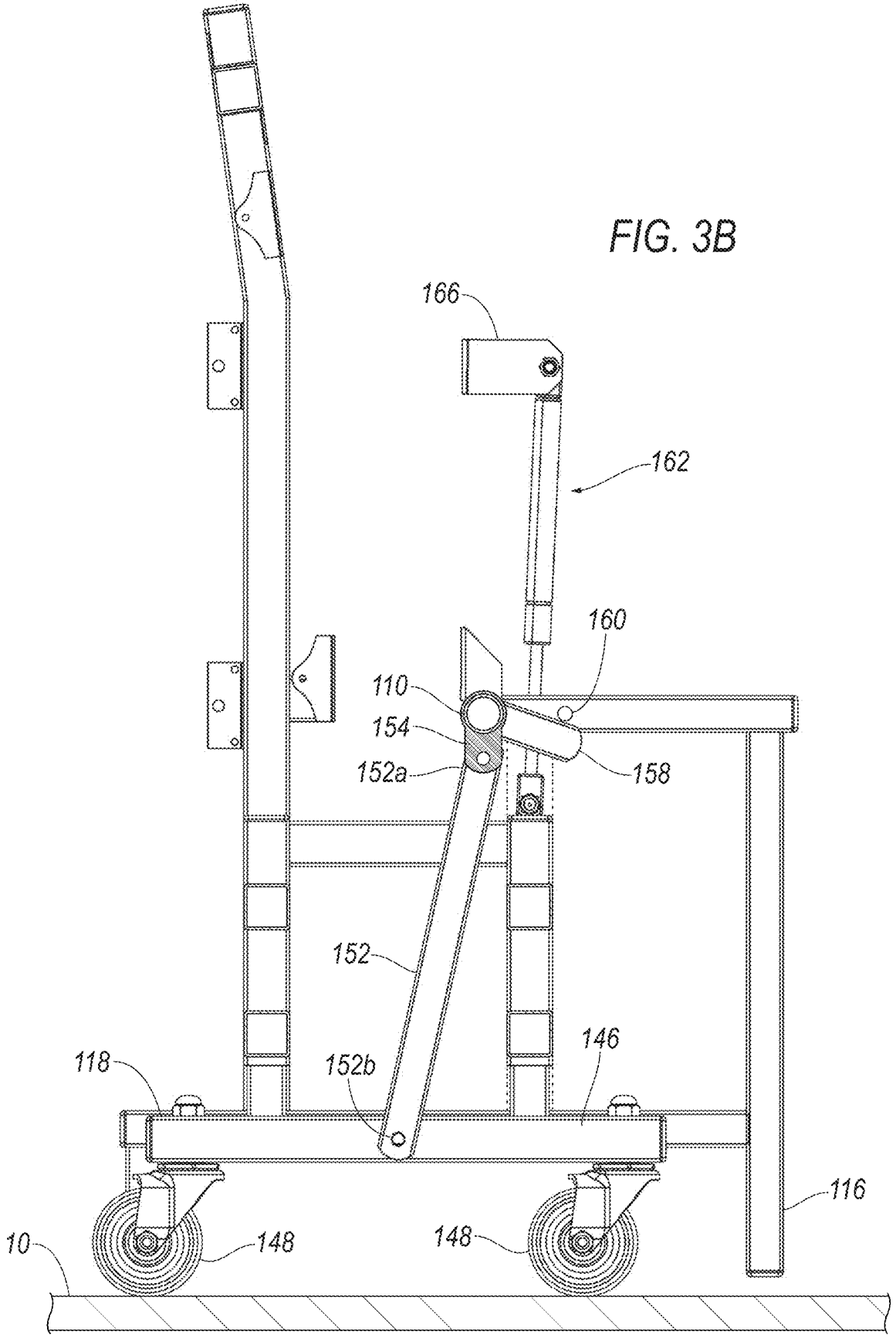
FIG. 3B is a sectional view of the seating assembly taken along the line 3B-3B of FIG. 2B.
Figure 4A:
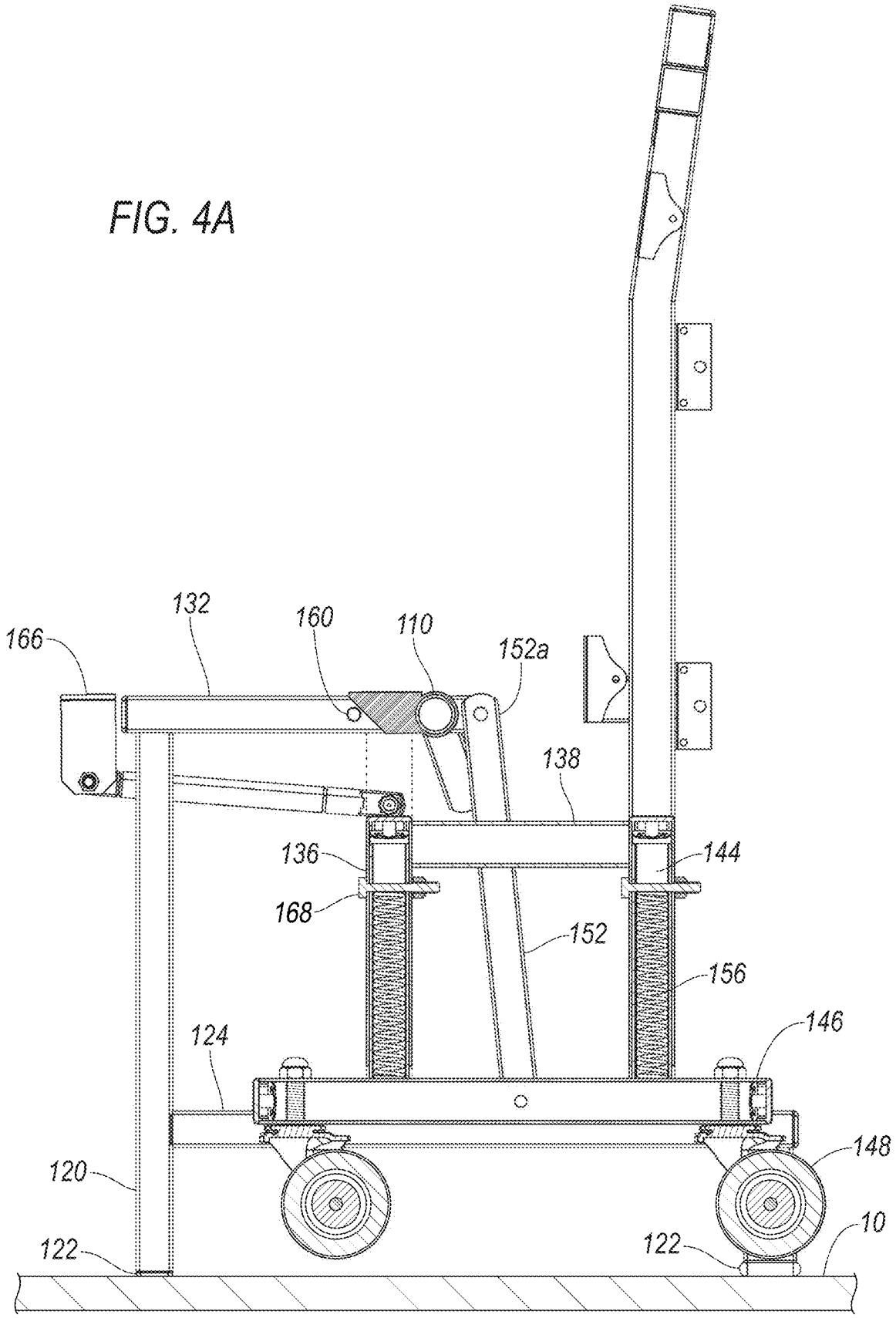
FIG. 4A is a sectional view of the seating assembly taken along the line 4A-4A of FIG. 2A.
Figure 4B:
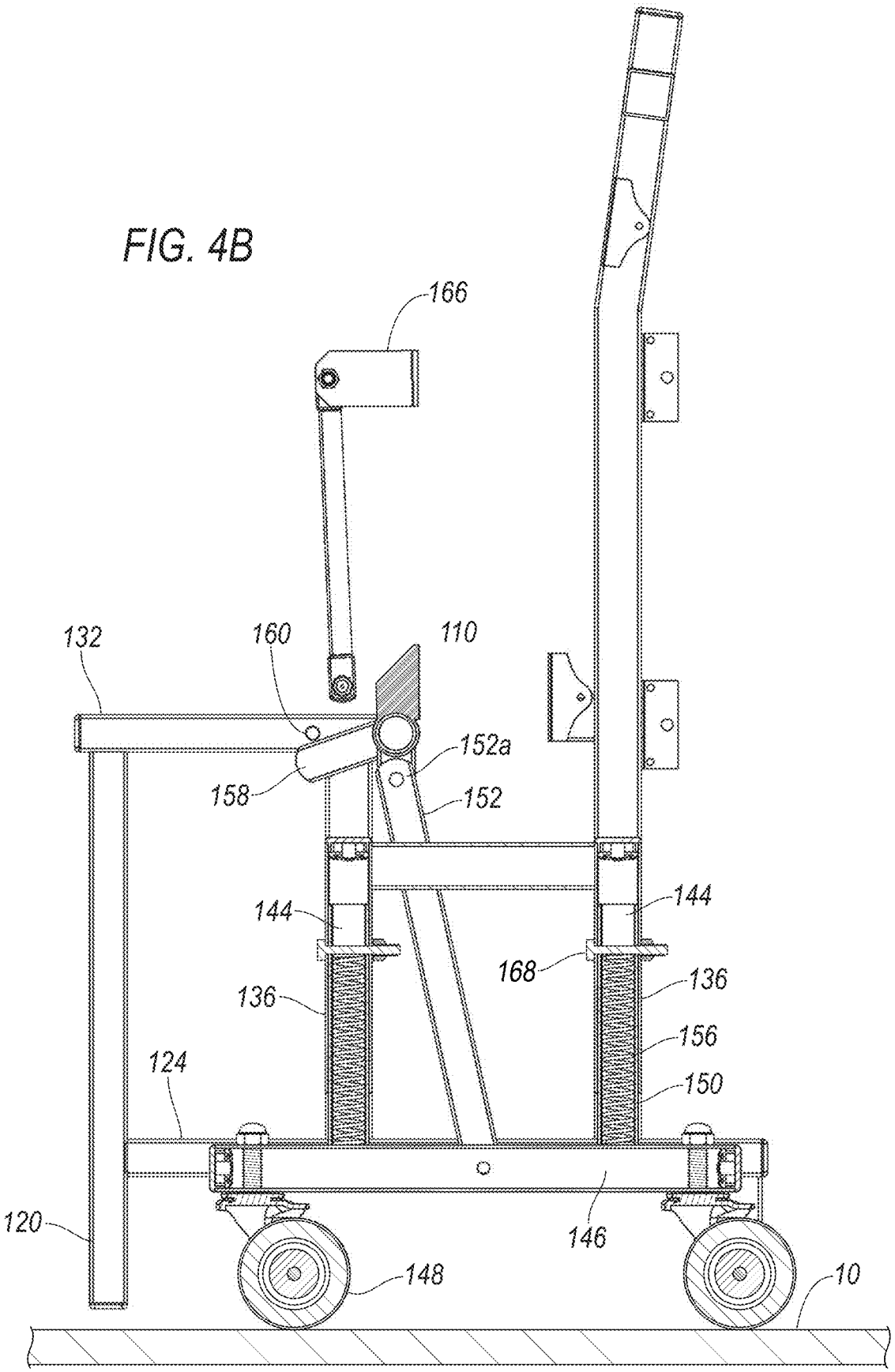
FIG. 4B is a sectional view of the seating assembly taken along the line 4B-4B of FIG. 2B.
Figure 5A:
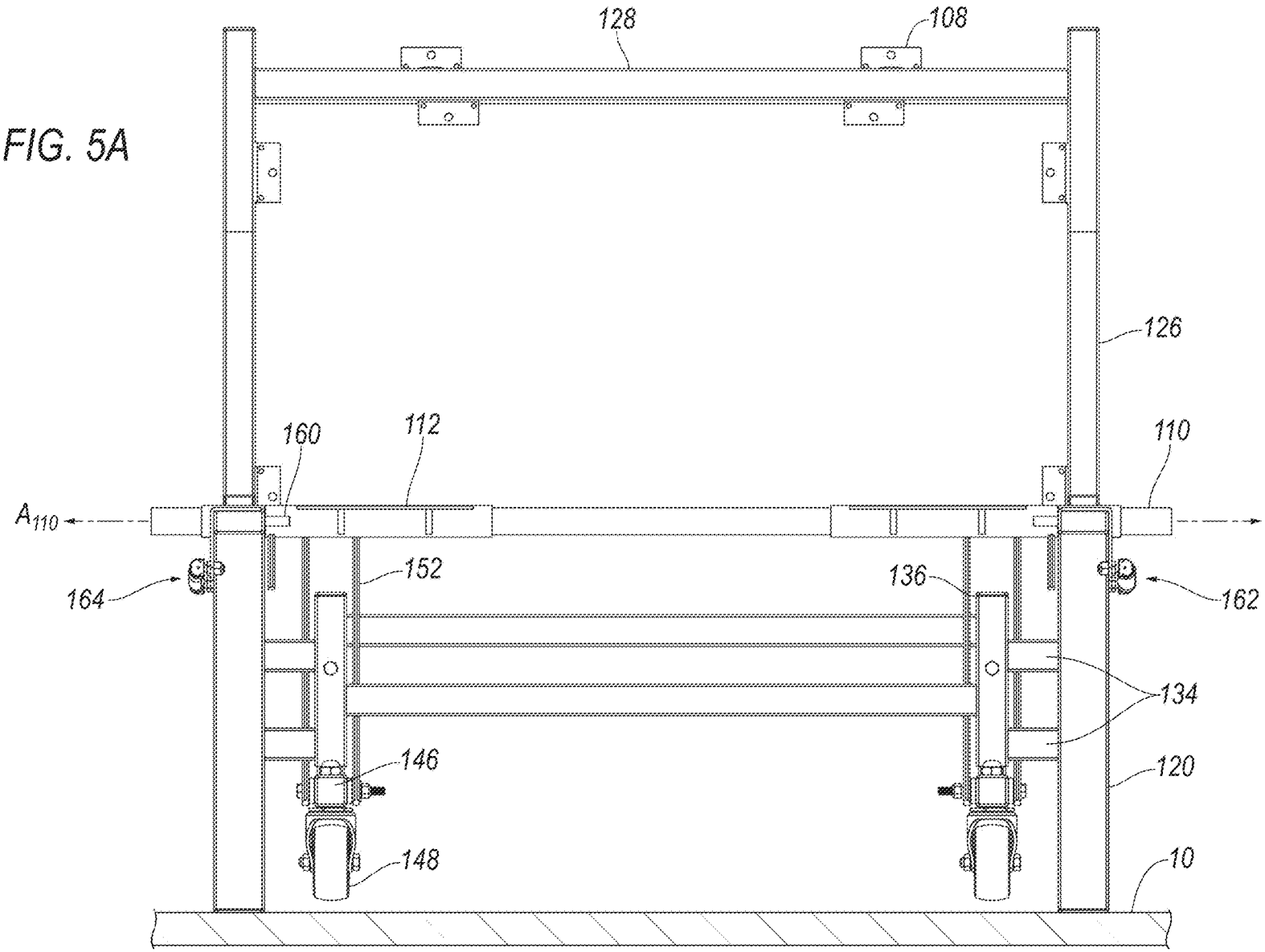
FIGS. 5A and 5B are front views of the seating assembly respectively in the sitting position and mobile position, with the seat and backrest of the seating assembly removed.
Figure 5B:
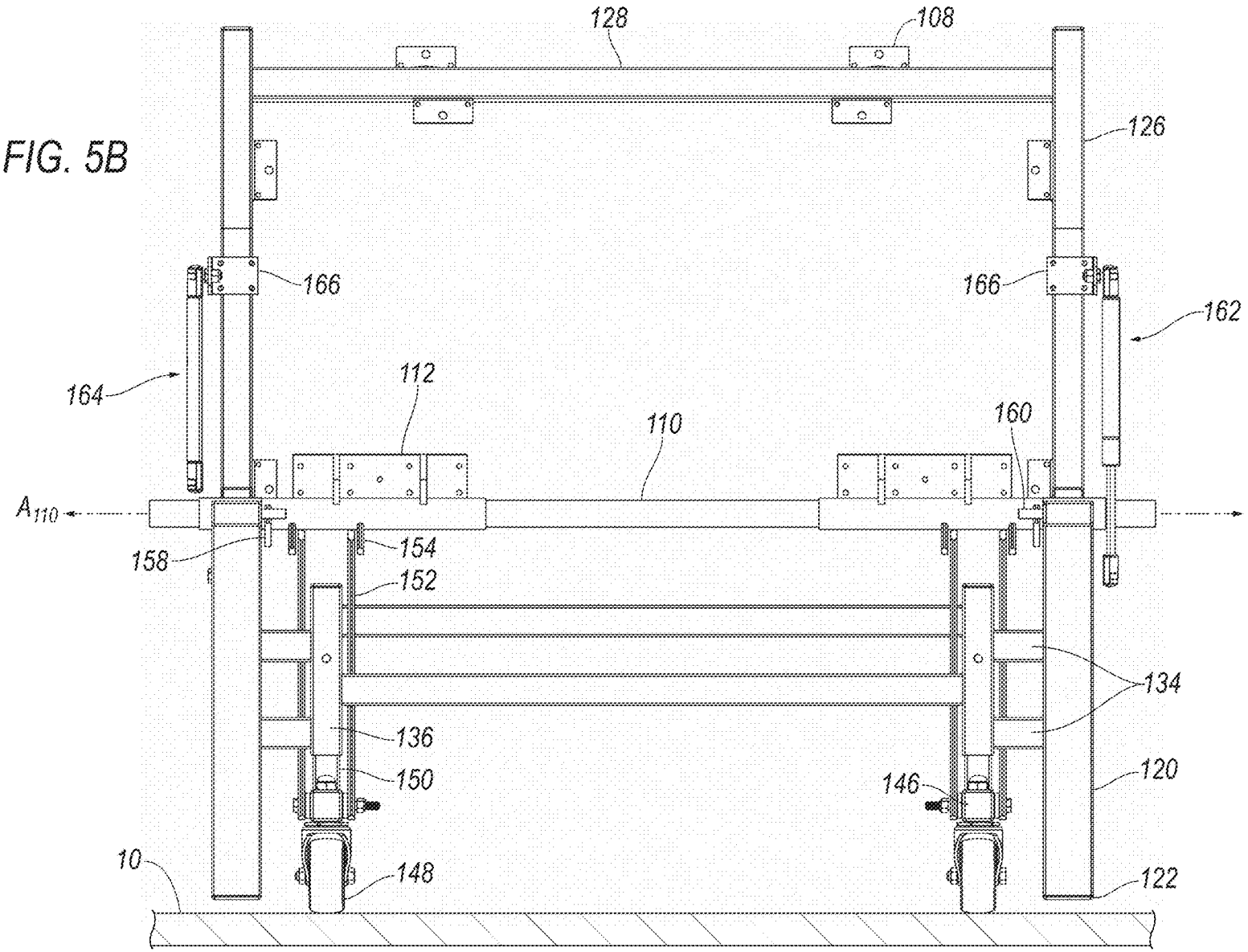
Figure 6A:
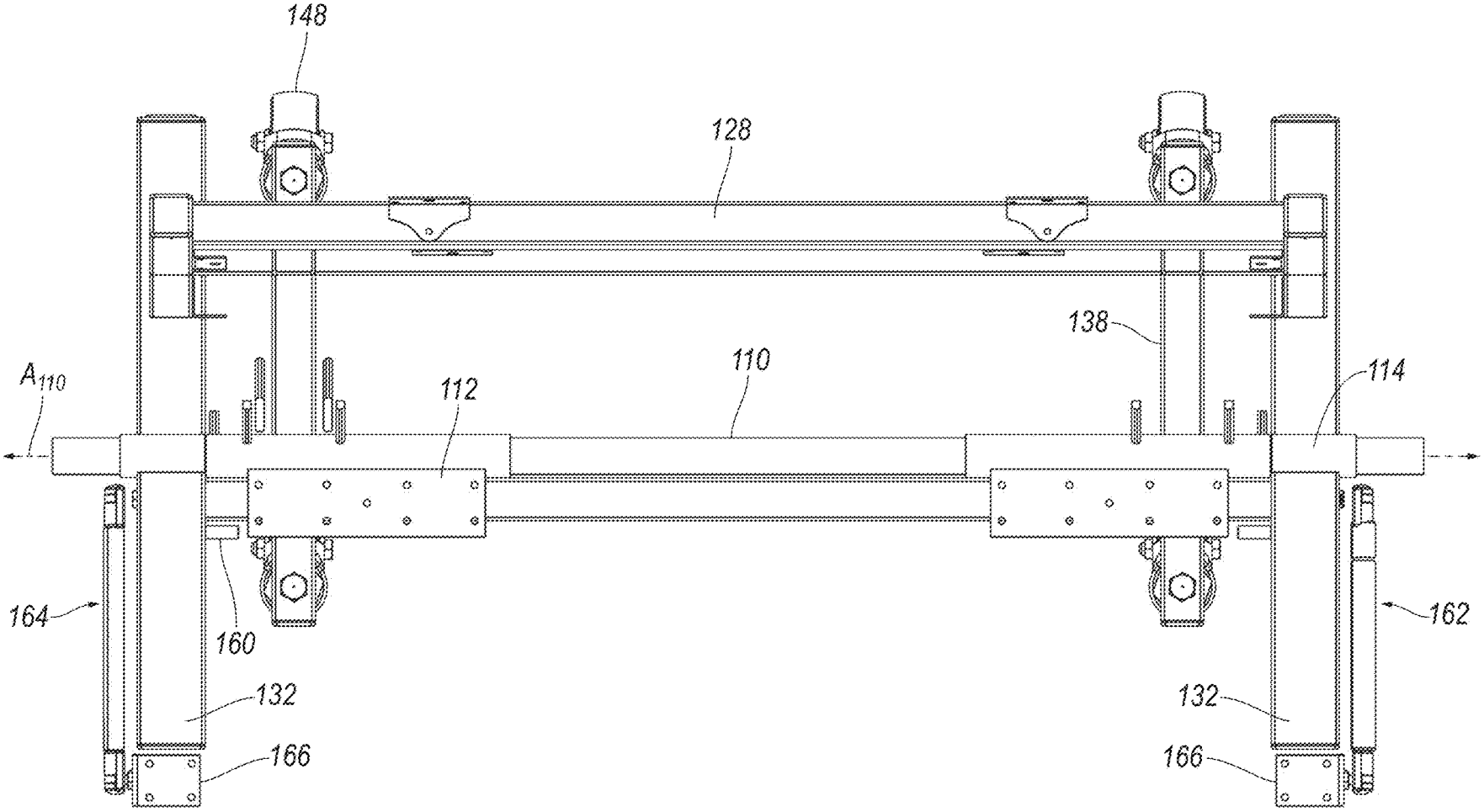
FIGS. 6A and 6B are overhead views of the seating assembly respectively in the sitting position and mobile position, with the seat and backrest of the seating assembly removed.
Figure 6B:
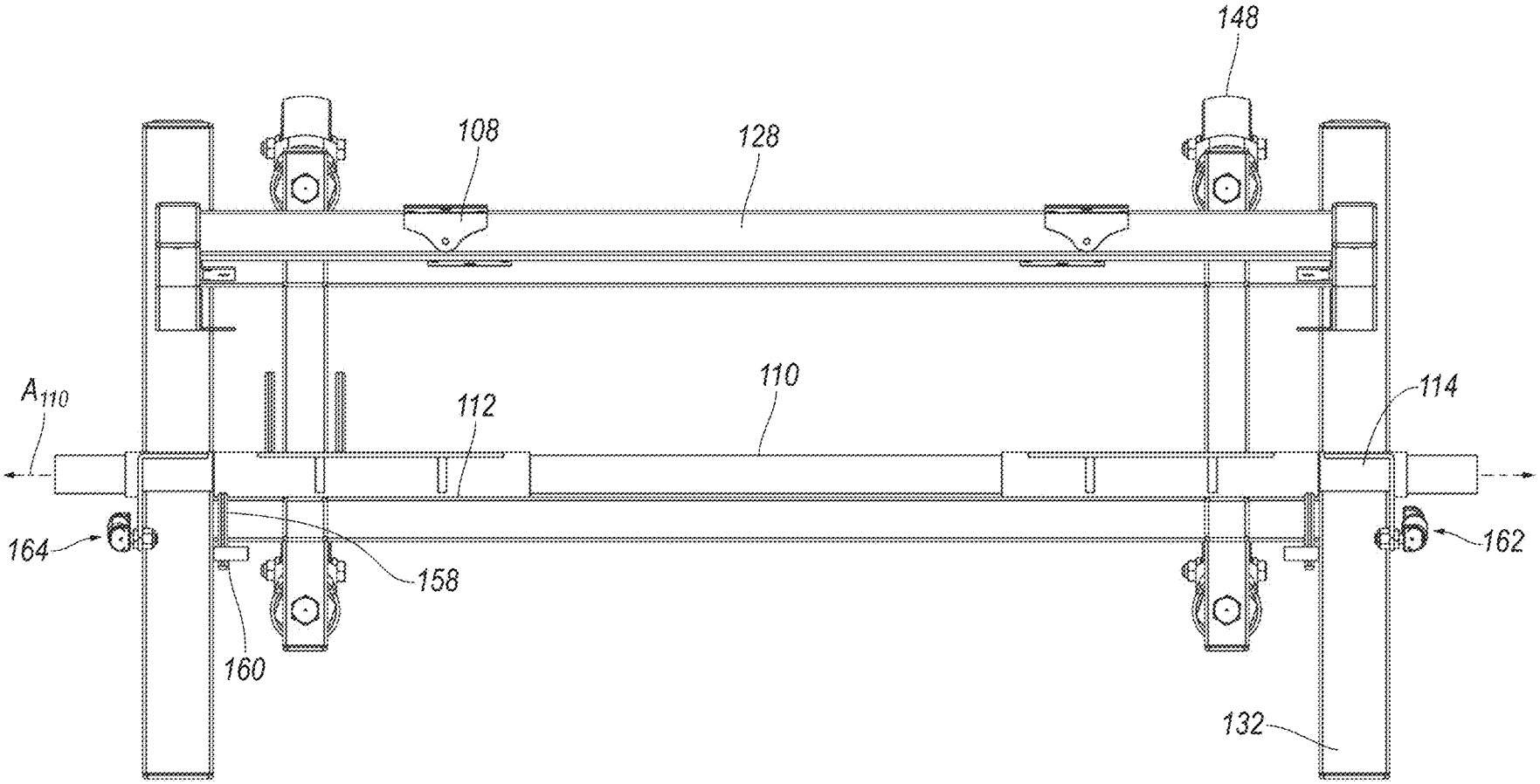

With the seating assembly 100 in the sitting position (FIG. 3A), a stationary portion or base 116 of the frame 106 supports the seating assembly 100 on the ground surface 10 and a mobile portion or base 118 of the frame 106 is at least partially raised or lifted or vertically spaced from the ground surface 10 to preclude the seating assembly 100 from being moved within the environment. Conversely, with the seating assembly 100 in the mobile position (FIG. 3B), the mobile base 118 supports the seating assembly 100 on the ground surface 10 and the stationary base 116 is at least partially raised or lifted or vertically spaced from the ground surface 10 to permit movement of the seating assembly 100 within the environment.

The stationary base 116 of the frame 106 includes four vertical supports or legs 120 with respective ends configured to engage the ground surface 10 with the seating assembly 100 in the sitting position. For example, the four legs 120 are positioned at respective corner regions of the frame 106 and include respective feet 122, such as non-slip rubber feet or hard plastic, slidable feet, at the ends of the legs 120 for supporting the seating assembly 100 and preventing movement relative to the ground surface 10. In the illustrated example, the rear legs 120 of the frame 106 include rubber feet 122 to prevent sliding along the ground surface 10 and the front legs 120 of the frame 106 include hard plastic feet 122 to allow sliding along the ground surface 10. Lower horizontal supports or cross-members 124 extend between front and rear legs 120 along opposing sides of the frame 106 and a backrest support 126 extends vertically from each cross-member 124. The backrest supports 126 are connected by a backrest cross-member 128, and the backrest support 126 and backrest cross-member 128 of the frame 106 are collectively configured to receive and support the backrest 104.

A pivot support 130 extends from each cross-member 124 between the backrest support 126 and the front leg 120, with a seat support 132 extending between upper ends of the pivot support 130 and the front leg 120 along the opposing sides of the frame 106. The bearings 114 that receive the pivot axle 110 may be disposed at respective junctions between the pivot support 130 and the seat support 132. With the seating assembly 100 in the sitting position, the seat 102 may be at least partially supported along opposing sides by the seat support 132, which may transfer weight to the ground surface 10 through the front legs 120 and through the pivot supports 130 to the cross-members 124 and rear legs 120.

A pair of connecting supports 134 extend laterally inward from each of the backrest supports 126 and the pivot supports 130. The connecting supports 134 along each of the backrest supports 126 and the pivot supports 130 are parallel and vertically spaced from one another. Thus, upper and lower connecting supports 134 extending respectively from the backrest supports 126 and pivot supports 130 along opposing sides of the frame 106 may be axially aligned with one another. Sleeves 136 extend vertically at the ends of upper and lower connecting supports 134 and generally parallel to the respective backrest supports 126 and the pivot supports 130. Accordingly, each side of the frame 106 includes one sleeve 136 extending parallel to the pivot support and attached to upper and lower connecting supports 134 and one sleeve 136 extending parallel to the backrest support 126 and attached to upper and lower connecting supports 134. A sleeve connector 138 may extend between upper ends of the respective sleeves 136 at each side of the frame 106. A front cross-member 140 extends between forward sleeves 136 at opposing sides of the frame 106 and a rear cross-member 142 extends between rearward sleeves 136 at opposing sides of the frame 106. Each sleeve 136 defines a bore or recess or receiving portion 144 that extends axially along the sleeve 136.

The mobile base 118 of the frame 106 includes two horizontal supports or braces 146 disposed inboard of the legs 120 of the stationary base 116 and that extend along opposing sides of the frame 106. Casters 148 are pivotally attached at opposing ends of each brace 146, such that the mobile base 118 includes four casters 148 with a respective caster 148 at or near each corner of the frame 106. When the mobile base 118 supports the seating assembly 100 in the mobile position, the casters 148 engage the ground surface 10 to allow the user to freely move the seating assembly 100 along the ground surface 10.

A pair of vertical support members 150 extend from upper surfaces of each brace 146 and are at least partially received along the bores 144 of the respective sleeves 136. That is, the vertical support members 150 may have an outer diameter or dimension configured to be received along the bores 144 of the sleeves 136 so that the vertical support members 150 (and thus the mobile base 118) may extend and retract axially along the bores 144 relative to the stationary base 116. As discussed further below, the bores 144 accommodate the vertical movement of the mobile base 118 relative to the stationary base 116 when the seating assembly 100 is adjusted between the sitting position and the mobile position and the casters 148 are disengaged and engaged with the ground surface 10. Although shown and described herein as formed from square tubular members (e.g., aluminum or steel tubing), it should be understood that the frame 106 may be formed from any suitable structural shape or material, such as hollow cylindrical members, solid members, plastic, and/or fiberglass.

Referring to FIGS. 3A-6B, pivot links or bars 152 are pivotally connected between the seat 102 and the mobile base 118 at opposing sides of the frame 106 to translate pivotal movement of the seat 102 to vertical movement of the mobile base 118 along the bores 144. That is, as the seating assembly 100 is adjusted between the sitting position and the mobile position, the pivot link 152 pivots relative to the seat 102 and the mobile base 118 to impart vertical movement of the mobile base 118 relative to the stationary base 116 and the ground surface 10.

Tabs or yokes 154 extend from the pivot axle 110 at opposing sides of the frame 106 and pivot together and in tandem about the pivot axle 110 with the seat 102. For example, the yoke 154 may be attached to or integrally formed with the mounting bracket 112 mounting the seat 102 at the pivot axle 110. A first end 152*a* of the pivot link 152 is pivotally attached to the yoke 154, such as via a pin received through the first end 152*a* and the yoke 154. A second end 152*b* of the pivot link 152 is pivotally attached to the brace 146 at the respective side of the frame 106, such as via a pin received through the second end 152*b* and the brace 146.

As the seat 102 pivots from the sitting position (FIGS. 3A and 4A) toward the backrest 104 and the mobile position (FIGS. 3B and 4B), the first end 152*a* of the pivot link 152 is moved downward along a pivotal arc (e.g., clockwise in FIG. 4A) via connection to the yoke 154. This downward movement urges the second end 152*b* of the pivot link 152 and the brace 146 toward the ground surface 10. That is, because the mobile base 118 is constrained by the vertical supports 150 along the bores 144, and because the pivot link 152 comprises a rigid structural member, the at least partially downward movement of the pivot link 152 caused by pivoting of the yoke 154 imparts axial movement of the mobile base 118 along the bores 144 and downward toward the ground surface 10. During pivotal movement of the seat 102 and yoke 154 and axial movement of the mobile base 118, the pivot link 152 pivots at the first end 152*a* relative to the yoke 154 and at the second end 152*b* relative to the brace 146 to accommodate any non-vertical movement between the yoke 154 and mobile base 118.

During adjustment of the seating assembly 100 from the sitting position toward the mobile position, as the casters 148 engage the ground surface 10, the feet 122 of the stationary base 116 are lifted from the ground surface 10 and the seating assembly 100 is supported at the mobile base 118. A biasing member 156, such as a compression spring or gas cylinder or torsion bar or other suitable biasing element, is disposed along each bore 144 between the stationary base 116 and the mobile base 118 and urges the mobile base 118 away from the stationary base 116 toward the ground surface 10 to bias the seating assembly 100 toward the mobile position and assist the user in pivoting the seat 102 and adjusting the seating assembly 100 to the mobile position. For example, the compression spring 156 is disposed between an upper surface of the brace 146 and a bolt or retainer 168 extending through the sleeve 136 and/or the vertical support 150. The retainer 168 may extend through an aperture in the sleeve 136 to maintain position of an upper end of the compression spring 156 relative to the stationary base 116 and extend through a slot in the vertical support 150 to allow for axial movement of the vertical support 150 and mobile base 118 along the bore 144 and relative to the retainer 168. Thus, with the seating assembly 100 in the sitting position, the user may simply lift and pivot the seat 102 toward the backrest 104 with the assistance of the compressing spring 156 to engage the casters 148 and lift the stationary base 116 from the ground surface 10 so that the seating assembly 100 may be moved within or removed from the environment.

The seat 102 pivots toward the mobile position until a stop tab 158 pivotally connected to the seat 102 engages a stop post 160 projecting from the frame 106. For example, the stop tab 158 may extend from the seat 102 or the mounting bracket 112 pivotally connecting the seat 102 and the pivot axle 110 so that the stop tab 158 pivots together and in tandem with the seat 102 about the pivot axis $A_{110}$. The stop post 160 extends from an inner side of the seat support 132. Thus, with the seating assembly 100 adjusted to the mobile position, the stop tab 158 engages the stop post 160 to preclude further pivoting of the seat 102 toward the backrest 104 and further adjustment of the seating assembly 100 beyond the mobile position, such as to maintain a threshold clearance between the sitting surface 102*a* of the seat 102 and the forward surface 104*a* of the backrest 104. The biasing force from the compression spring 156 may resist movement of the seat 102 away from the backrest 104 and thus resist adjustment of the seating assembly 100 from the mobile position back toward the sitting position.

When the user desires to adjust the seating assembly 100 from the mobile position toward the sitting position, the user may apply a downward force at the seat 102 to pivot the seat 102 away from the backrest 104. As the seat 102 pivots from the mobile position toward the seat support 132 and the sitting position, the first end 152*a* of the pivot link 152 is moved upward along a pivotal arc (e.g., clockwise in FIG. 3B) via connection to the yoke 154. This upward movement urges the second end 152*b* of the pivot link 152 and the brace 146 upward away from the ground surface 10. The vertical supports 150 move upward along the bores 144 and the mobile base 118 is moved against the biasing force of the compression spring 156. As the mobile base 118 retracts along the bores 144, the stationary base 116 is lowered and the feet 122 engage the ground surface 10. As the stationary base 116 engages the ground surface 10, the casters 148 are lifted from the ground surface 10 and the seating assembly 100 is supported at the stationary base 116. The gravitational force from pivoting the seat downward may overcome the biasing force of the compression spring 156 and assist the user in adjusting the seating assembly 100 to the sitting position. Thus, with the seating assembly 100 in the mobile position, the user may simply lower the seat 102 away from the backrest 104 to disengage the casters 148 and lower the stationary base 116 into engagement with the ground surface 10 so that the seating assembly 100 may be set in position within the environment and ready to receive users at the sitting surface 102*a*.

In some examples, the seating assembly 100 includes a biasing mechanism 162 along one side of the frame 106 and a dampening mechanism 164 along the other side of the frame 106. For example, the biasing mechanism 162 and the dampening mechanism 164 may include respective gas cylinders, compression springs, torsion bars, or other suitable biasing elements that pivotally attach at the frame 106 and the seat 102. In the illustrated example, the biasing mechanism 162 and the dampening mechanism 164 each pivotally attach at first ends to outer sides of the pivot supports 130 and at second ends to mounting brackets 166 at the seat 102.

The biasing mechanism 162 may be configured to bias the seating assembly 100 toward the mobile position to further assist the user in moving the seating assembly 100 from the sitting position toward the mobile position. For example, with the seating assembly 100 in the sitting position (FIG. 3A), the biasing mechanism 162 may be angled at least partially upward and the biasing mechanism 162 may expand to impart force so as to urge the seat 102 upward and toward the backrest 104 and bias the seating assembly 100 toward the mobile position. In other examples, the biasing mechanism 162 may be angled at least partially downward with the seating assembly 100 in the sitting position and/or the biasing mechanism 162 may retract to impart force so as to urge the seat 102 downward and away from the backrest 104 and bias the seating assembly 100 toward the sitting position. The seating assembly 100 may include two biasing mechanisms that urge the seat 102 in the same direction (e.g., respective biasing mechanisms are disposed along the opposing sides of the frame 106 and both biasing mechanisms urge the seating assembly 100 toward the mobile position).

Optionally, the seating assembly 100 may include oppositely configured biasing mechanisms (e.g., respective biasing mechanisms are disposed along the opposing sides of the frame 106 and one biasing mechanism urges the seating assembly 100 toward the mobile position and another biasing mechanism urges the seating assembly 100 toward the sitting position). For example, the differently configured biasing mechanisms may only be engaged or active at the respective ends of the range of motion of the seat 102. That is, the one biasing mechanism that urges the seat 102 toward the backrest 104 may not be engaged and active with the seating assembly 100 in the mobile position and the other biasing mechanism that urges the seat 102 away from the backrest 104 may not be engaged and active with the seating assembly 100 in the sitting position. Thus, the seating assembly 100 may be easily adjusted between positions without requiring the user to overcome or work against biasing forces.

The dampening mechanism 164 is configured to engage as the seat 102 is pivoted from the mobile position and approaches the sitting position to resist movement of the seat 102 and thus slow or dampen movement of the seat 102 along the concluding portion of its range of motion toward the sitting position. That is, the dampening mechanism 164 may only be engaged or active at the end of the range of motion of the seat 102 and the dampening mechanism 164 may not be engaged and active as the seating assembly 100 moves toward the mobile position. Accordingly, the dampening mechanism 164 may allow the seating assembly 100 to adjust to the sitting position at a controlled or reduced rate so that the seat 102 does not slam down or pose an injury risk to the user without increasing the difficulty for the user to move the seating assembly 100 out of the mobile position.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

A number of implementations have been described. Nevertheless, it will be understood that various modifications may be made without departing from the spirit and scope of the disclosure. Accordingly, other implementations are within the scope of the following claims.

What is claimed is:

1. A seating assembly comprising:

a seat comprising a sitting surface;

a backrest;

a frame supporting the seat and the backrest, the frame comprising a stationary base and a mobile base;

a pivot link having a first end pivotally connected to the seat and a second end opposite the first end pivotally connected to the mobile base;

wherein the seating assembly is adjustable between:

a sitting position, where the stationary base supports the seating assembly on a ground surface, the sitting surface extends generally parallel to the ground surface, and the mobile base is vertically spaced from the ground surface; and a mobile position, where the seat is pivoted relative to the frame to move the sitting surface toward the backrest, the mobile base supports the seating assembly on the ground surface, and the stationary base is vertically spaced from the ground surface; and wherein, as the seating assembly is adjusted between the sitting position and the mobile position, the first end of the pivot link pivots relative to the seat and the second end of the pivot link pivots relative to the mobile base to impart vertical movement of the mobile base relative to the stationary base and the ground surface.

2. The seating assembly of claim 1, wherein the seat comprises a pivot member pivotally connected to the frame and defining a pivot axis, the seat pivoting about the pivot axis as the seating assembly is adjusted between the sitting position and the mobile position.

3. The seating assembly of claim 2, wherein a yoke extends from the pivot member and pivots about the pivot axis together and in tandem with the seat, the first end of the pivot link pivotally connected to the yoke.

4. The seating assembly of claim 1, wherein the pivot link comprises a bar.

5. The seating assembly of claim 1, wherein the mobile base comprises a support member at least partially received along a bore of the stationary base, the support member moving along the bore as the mobile base moves vertically relative to the stationary base and the ground surface.

6. The seating assembly of claim 5, further comprising a biasing member along the bore between the stationary base and the mobile base that urges the mobile base away from the stationary base toward the ground surface to bias the frame toward the mobile position.

7. The seating assembly of claim 1, further comprising a biasing mechanism between the frame and the seat, the biasing mechanism, with the seating assembly in the sitting position, urges the seat toward the backrest to bias the seating assembly toward the mobile position.

8. The seating assembly of claim 1, further comprising a dampening mechanism between the frame and the seat, the dampening mechanism engages as the seating assembly approaches the sitting position to dampen pivotal movement of the seat relative to the frame.

9. The seating assembly of claim 1, wherein the seat comprises a tab and the frame comprises a post, the tab pivoting together and in tandem with the seat, and, with the seating assembly in the mobile position, the tab engages the post to preclude further pivoting of the seat toward the backrest and further adjustment of the seating assembly from the sitting position beyond the mobile position.

10. The seating assembly of claim 1, wherein the mobile base comprises a set of casters, the set of casters enabling movement of the seating assembly along the ground surface when the seating assembly is in the mobile position.

11. A seating assembly comprising:

a seat comprising a sitting surface;

a backrest;

a frame supporting the seat and the backrest, the frame comprising a stationary base and a mobile base, the mobile base comprising a support member at least partially received along a bore of the stationary base;

a pivot link having a first end pivotally connected to the seat and a second end opposite the first end pivotally connected to the mobile base;

wherein the seating assembly is adjustable between:

a sitting position, where the stationary base supports the seating assembly on a ground surface, the sitting surface extends generally parallel to the ground surface, and the mobile base is vertically spaced from the ground surface; and a mobile position, where the seat is pivoted relative to the frame to move the sitting surface toward the backrest, the mobile base supports the seating assembly on the ground surface, and the stationary base is vertically spaced from the ground surface;

wherein, as the seating assembly is adjusted between the sitting position and the mobile position, the first end of the pivot link pivots relative to the seat and the second end of the pivot link pivots relative to the mobile base to impart vertical movement of the mobile base relative to the stationary base and the ground surface, the support member of the mobile base moving along the bore of the stationary base as the mobile base moves vertically relative to the stationary base and the ground surface; and wherein the seat comprises a tab and the frame comprises a post, the tab pivoting together and in tandem with the seat, and, with the seating assembly in the mobile position, the tab engages the post to preclude further pivoting of the seat toward the backrest and further adjustment of the seating assembly from the sitting position beyond the mobile position.

12. The seating assembly of claim 11, wherein the seat comprises a pivot member pivotally connected to the frame and defining a pivot axis, the seat pivoting about the pivot axis as the seating assembly is adjusted between the sitting position and the mobile position.

13. The seating assembly of claim 11, wherein the pivot link comprises a bar.

14. The seating assembly of claim 11, further comprising a biasing member along the bore between the stationary base and the mobile base that urges the mobile base away from the stationary base toward the ground surface to bias the frame toward the mobile position.

15. The seating assembly of claim 11, further comprising a biasing mechanism between the frame and the seat, the biasing mechanism, with the seating assembly in the sitting position, urges the seat toward the backrest to bias the seating assembly toward the mobile position.

16. A seating assembly comprising:

a seat comprising a sitting surface and a pivot member;

a backrest;

a frame supporting the seat and the backrest, the frame comprising a stationary base and a mobile base, the mobile base comprising a support member at least partially received along a bore of the stationary base, and the pivot member of the seat pivotally connected to the frame and defining a pivot axis;

a pivot link having a first end pivotally connected to a yoke that extends from the pivot member and a second end opposite the first end pivotally connected to the mobile base, the yoke pivoting together and in tandem with the seat;

wherein the seating assembly is adjustable between:

a sitting position, where the stationary base supports the seating assembly on a ground surface, the sitting surface extends generally parallel to the ground surface, and the mobile base is vertically spaced from the ground surface; and a mobile position, where the seat is pivoted relative to the frame about the pivot axis to move the sitting surface toward the backrest, the mobile base supports the seating assembly on the ground surface, and the stationary base is vertically spaced from the ground surface; and wherein, as the seating assembly is adjusted between the sitting position and the mobile position, the first end of the pivot link pivots relative to the seat and the yoke and the second end of the pivot link pivots relative to the mobile base to impart vertical movement of the mobile base relative to the stationary base and the ground surface, the support member of the mobile base moving along the bore of the stationary base as the mobile base moves vertically relative to the stationary base and the ground surface.

17. The seating assembly of claim 16, wherein the pivot link comprises a bar.

18. The seating assembly of claim 16, further comprising a biasing member along the bore between the stationary base and the mobile base that urges the mobile base away from the stationary base toward the ground surface to bias the frame toward the mobile position.

19. The seating assembly of claim 16, further comprising a dampening mechanism between the frame and the seat, the dampening mechanism engages as the seating assembly approaches the sitting position to dampen pivotal movement of the seat relative to the frame.

20. The seating assembly of claim 16, wherein the seat comprises a tab and the frame comprises a post, the tab pivoting together and in tandem with the seat, and, with the seating assembly in the mobile position, the tab engages the post to preclude further pivoting of the seat toward the backrest and further adjustment of the seating assembly from the sitting position beyond the mobile position.

* * * * *